US011802702B2

(12) United States Patent
Kato et al.

(10) Patent No.: US 11,802,702 B2
(45) Date of Patent: Oct. 31, 2023

(54) CONTROLLER OF AIR CONDITIONING APPARATUS, OUTDOOR UNIT, RELAY UNIT, HEAT SOURCE UNIT, AND AIR CONDITIONING APPARATUS

(71) Applicant: Mitsubishi Electric Corporation, Tokyo (JP)

(72) Inventors: Naoki Kato, Tokyo (JP); Yuji Motomura, Tokyo (JP); Naofumi Takenaka, Tokyo (JP); Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 241 days.

(21) Appl. No.: 17/419,045

(22) PCT Filed: Feb. 5, 2019

(86) PCT No.: PCT/JP2019/004081
§ 371 (c)(1),
(2) Date: Jun. 28, 2021

(87) PCT Pub. No.: WO2020/161805
PCT Pub. Date: Aug. 13, 2020

(65) Prior Publication Data
US 2022/0082283 A1 Mar. 17, 2022

(51) Int. Cl.
*F24F 11/42* (2018.01)
*F24F 11/84* (2018.01)
(Continued)

(52) U.S. Cl.
CPC ..... *F24F 11/42* (2018.01); *F24F 1/0003* (2013.01); *F24F 5/00* (2013.01); *F24F 11/64* (2018.01); *F24F 11/84* (2018.01); *F25B 2347/02* (2013.01)

(58) Field of Classification Search
CPC .. F24F 11/42; F24F 1/0003; F24F 5/00; F24F 11/64; F24F 11/84; F25B 2347/02;
(Continued)

(56) References Cited

U.S. PATENT DOCUMENTS

2011/0113802 A1* 5/2011 Wakamoto ..... F24F 3/06 62/196.1
2012/0304675 A1* 12/2012 Motomura ..... F24F 3/06 62/156

(Continued)

FOREIGN PATENT DOCUMENTS

JP 2004-353903 A 12/2004
JP 2009-041860 A 2/2009

*Primary Examiner* — Nelson J Nieves
(74) *Attorney, Agent, or Firm* — POSZ LAW GROUP, PLC

(57) ABSTRACT

An air conditioning apparatus includes: a second heat exchanger; a plurality of third heat exchangers; and a plurality of flow rate control valves. In a defrosting mode, when a heat exchanger that is not being requested to perform air conditioning includes a first device having a set temperature lower than or equal to a current room temperature and a second device which is set so as not to perform air conditioning, a controller is configured to control a first flow rate control valve corresponding to the first device and a second flow rate control valve corresponding to the second device such that a degree of opening of the first flow rate control valve is higher than or equal to a degree of opening of the second flow rate control valve.

9 Claims, 12 Drawing Sheets

(51) Int. Cl.
*F24F 11/64* (2018.01)
*F24F 1/0003* (2019.01)
*F24F 5/00* (2006.01)

(58) Field of Classification Search
CPC ..... F25B 2313/023; F25B 2313/0232; F25B 2313/02321; F25B 2313/02322; F25B 2313/02323; F25B 2313/0233; F25B 2313/02331; F25B 2313/02332; F25B 2313/02333; F25B 2313/02334
See application file for complete search history.

(56) References Cited

U.S. PATENT DOCUMENTS

| | | | | |
|---|---|---|---|---|
| 2014/0182320 | A1* | 7/2014 | Hatomura | F25B 13/00 62/278 |
| 2015/0128628 | A1* | 5/2015 | Kawagoe | F24F 11/84 62/160 |
| 2015/0260440 | A1* | 9/2015 | Shimamoto | F25B 49/02 62/228.1 |
| 2015/0285519 | A1* | 10/2015 | Motomura | F25B 13/00 62/324.1 |
| 2015/0292758 | A1* | 10/2015 | Motomura | F24F 5/001 29/890.035 |
| 2015/0369498 | A1* | 12/2015 | Motomura | F24F 3/065 62/160 |
| 2021/0041128 | A1* | 2/2021 | Kato | F24F 11/83 |
| 2021/0207859 | A1* | 7/2021 | Kato | F25B 13/00 |
| 2021/0348789 | A1* | 11/2021 | Fukui | F24F 11/67 |

* cited by examiner

<DURING HEATING-DEFROSTING (STATE A)>

<DURING HEATING-DEFROSTING (STATE B)>

CONTROLLER OF AIR CONDITIONING APPARATUS, OUTDOOR UNIT, RELAY UNIT, HEAT SOURCE UNIT, AND AIR CONDITIONING APPARATUS

CROSS-REFERENCE TO RELATED APPLICATION

This application is a U.S. National Stage Application of International Application No. PCT/JP2019/004081, filed on Feb. 5, 2019, the contents of which are incorporated herein by reference.

TECHNICAL FIELD

The present disclosure relates to a controller of an air conditioning apparatus, an outdoor unit, a relay unit, a heat source unit, and an air conditioning apparatus.

BACKGROUND

Conventionally, an indirect air conditioning apparatus is known that generates hot and/or cold water by a heat source unit such as a heat pump, and delivers the water to an indoor unit through a water pump and a pipe to perform heating and/or cooling in the interior of a room.

Such an indirect air conditioning apparatus uses water or brine as a use-side heat medium, and thus has been receiving increasing attention in recent years in order to reduce refrigerant usage.

In Japanese Patent Laying-Open No. 2009-41860, when a water heat exchanger for generating hot and/or cold water is likely to freeze, a bypass circuit is opened and an expansion valve is closed, causing low-temperature refrigerant during defrosting to bypass, and not to flow into, the water heat exchanger, to prevent the freezing of the water heat exchanger.

PATENT LITERATURE

PTL 1: Japanese Patent Laying-Open No. 2009-41860

In a configuration that prevents refrigerant from flowing through a water heat exchanger acting as an evaporator during defrosting by means of a bypass circuit, as in Japanese Patent Laying-Open No. 2009-41860, heat absorption from water to the refrigerant at the water heat exchanger does not take place, resulting in a longer defrosting time. This causes a longer interruption time of heating and thus reduces room temperature, possibly resulting in compromised comfort.

SUMMARY

The present disclosure has been made to solve the problem described above, and has an object to provide a controller, of an indirect air conditioning apparatus using a heat medium such as water or brine, which is capable of ensuring heat absorption from the heat medium while preventing freezing of the heat medium, to shorten a length of time required for defrosting operation.

The present disclosure relates to a controller that controls an air conditioning apparatus. The air conditioning apparatus includes a compressor, a first heat exchanger, a second heat exchanger, a plurality of third heat exchangers, a plurality of flow rate control valves, and a pump. The compressor is configured to compress a first heat medium. The first heat exchanger is configured to exchange heat between the first heat medium and outdoor air. The second heat exchanger is configured to exchange heat between the first heat medium and a second heat medium. The plurality of third heat exchangers are each configured to exchange heat between the second heat medium and indoor air. The plurality of flow rate control valves are each configured to control a flow rate of the second heat medium flowing through a corresponding one of the plurality of third heat exchangers. The pump is configured to circulate the second heat medium between the plurality of third heat exchangers and the second heat exchanger. The air conditioning apparatus is configured to operate in operation modes including a heating mode and a defrosting mode.

In the heating mode, the controller is configured to open the flow rate control valve corresponding to a heat exchanger that is being requested to perform air conditioning of the plurality of third heat exchangers, and to close the flow rate control valve corresponding to a heat exchanger that is not being requested to perform air conditioning of the plurality of third heat exchangers.

In the defrosting mode, the controller is configured to open the flow rate control valve corresponding to the heat exchanger that is not being requested to perform air conditioning of the plurality of third heat exchangers. When the heat exchanger that is not being requested to perform air conditioning includes a first device having a set temperature lower than or equal to a current room temperature and a second device which is set so as not to perform air conditioning, the controller is configured to control a first flow rate control valve corresponding to the first device and a second flow rate control valve corresponding to the second device such that a degree of opening of the first flow rate control valve is higher than or equal to a degree of opening of the second flow rate control valve.

According to the controller of the present disclosure, a defrosting time of the air conditioning apparatus is shortened, and accordingly, comfort during air conditioning is improved.

DETAILED DESCRIPTION

Figure 1:
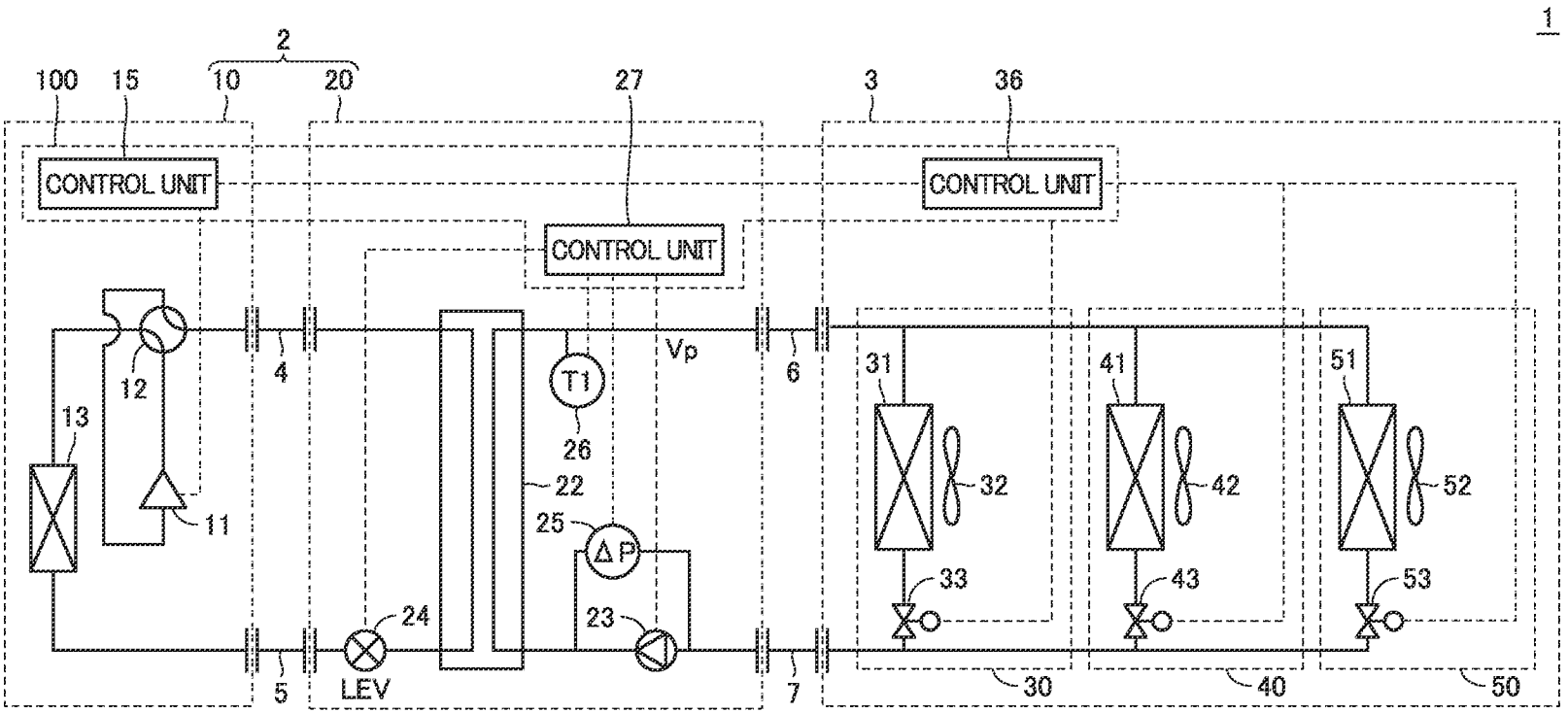
FIG. 1 is a diagram showing the configuration of an air conditioning apparatus according to a first embodiment.

In the following, embodiments of the present disclosure will be described in detail with reference to the drawings. While a plurality of embodiments are described below, it has been intended from the time of filing of the present application to appropriately combine configurations described in the respective embodiments. Note that the same or corresponding elements are designated by the same symbols in the drawings and will not be described repeatedly.

First Embodiment

FIG. 1 is a diagram showing the configuration of an air conditioning apparatus according to a first embodiment. Referring to FIG. 1, an air conditioning apparatus 1 includes a heat source unit 2, an indoor air conditioning device 3, and a controller 100. Heat source unit 2 includes an outdoor unit 10 and a relay unit 20. In the following description, a first heat medium can be exemplified by refrigerant, and a second heat medium can be exemplified by water or brine.

Outdoor unit 10 includes part of a refrigeration cycle that operates as a heat source or a cold source for the first heat medium. Outdoor unit 10 includes a compressor 11, a four-way valve 12, and a first heat exchanger 13. FIG. 1 shows an example where four-way valve 12 performs cooling or defrosting, with heat source unit 2 serving as a cold source. When four-way valve 12 is switched to reverse the direction of circulation of the refrigerant, heating is performed, with heat source unit 2 serving as a heat source.

Relay unit 20 includes a second heat exchanger 22, a pump 23 for circulating the second heat medium between the second heat exchanger and indoor air conditioning device 3, an expansion valve 24, a pressure sensor 25 for detecting a differential pressure $\Delta P$ before and after pump 23, and a temperature sensor 26 for measuring a temperature of the second heat medium that has passed through second heat exchanger 22. Second heat exchanger 22 exchanges heat between the first heat medium and the second heat medium. A plate heat exchanger can be used as second heat exchanger 22.

Outdoor unit 10 and relay unit 20 are connected to each other by pipes 4 and 5 for flowing the first heat medium. Compressor 11, four-way valve 12, first heat exchanger 13, expansion valve 24, and second heat exchanger 22 form a first heat medium circuit which is a refrigeration cycle using the first heat medium. Note that outdoor unit 10 and relay unit 20 may be integrated together in heat source unit 2. If they are integrated together, pipes 4 and 5 are accommodated in a casing.

Indoor air conditioning device 3 and relay unit 20 are connected to each other by pipes 6 and 7 for flowing the second heat medium. Indoor air conditioning device 3 includes an indoor unit 30, an indoor unit 40 and an indoor unit 50. Indoor units 30, 40 and 50 are connected in parallel with one another between pipe 6 and pipe 7.

Indoor unit 30 includes a heat exchanger 31, a fan 32 for delivering indoor air to heat exchanger 31, and a flow rate control valve 33 for controlling a flow rate of the second heat medium. Heat exchanger 31 exchanges heat between the second heat medium and the indoor air.

Indoor unit 40 includes a heat exchanger 41, a fan 42 for delivering indoor air to heat exchanger 41, and a flow rate control valve 43 for controlling a flow rate of the second heat medium. Heat exchanger 41 exchanges heat between the second heat medium and the indoor air.

Indoor unit 50 includes a heat exchanger 51, a fan 52 for delivering indoor air to heat exchanger 51, and a flow rate control valve 53 for controlling a flow rate of the second heat medium. Heat exchanger 51 exchanges heat between the second heat medium and the indoor air.

Note that pump 23, second heat exchanger 22, and third heat exchanger 31, heat exchanger 41 and heat exchanger 51 connected in parallel with one another form a second heat medium circuit using the second heat medium. While an air conditioning apparatus having three indoor units is illustrated by way of example in the present embodiment, any number of indoor units may be provided.

Control units 15, 27 and 36 distributed across outdoor unit 10, relay unit 20 and indoor air conditioning device 3 cooperate with one another to operate as controller 100. Controller 100 controls compressor 11, expansion valve 24, pump 23, flow rate control valves 33, 43, 53, and fans 32, 42, 52 in response to outputs from pressure sensor 25 and temperature sensor 26.

Note that one of control units 15, 27 and 36 may serve as a controller, and control compressor 11, expansion valve 24, pump 23, flow rate control valves 33, 43, 53, and fans 32, 42, 52 based on data detected by the other control units 15, 27 and 36. Note that if heat source unit 2 has outdoor unit 10 and relay unit 20 that are integrated together, control units 15 and 27 may cooperate with each other to operate as a controller based on data detected by control unit 36.

In the configuration of FIG. 1, air conditioning apparatus 1 determines, using temperature sensor 26, whether or not the second heat medium is likely to freeze. When the second heat medium is likely to freeze during defrosting, the flow rate control valves are opened and the fans are rotated in the indoor units to introduce heat from the indoor air into the second heat medium, to prevent the freezing. This freezing-preventing operation will be sequentially described below.

For ease of explanation, first, an example is described where the operation of indoor unit 50 is stopped by a remote controller or the like (hereinafter referred to as "SW-OFF state"), and indoor unit 30 and indoor unit 40 are performing heating operation. In this case, it is assumed that room temperature has not reached a target temperature (hereinafter referred to as "thermo-ON state") in indoor unit 30, and room temperature has reached a target temperature (hereinafter referred to as "thermo-OFF state") in indoor unit 40.

Figure 2:
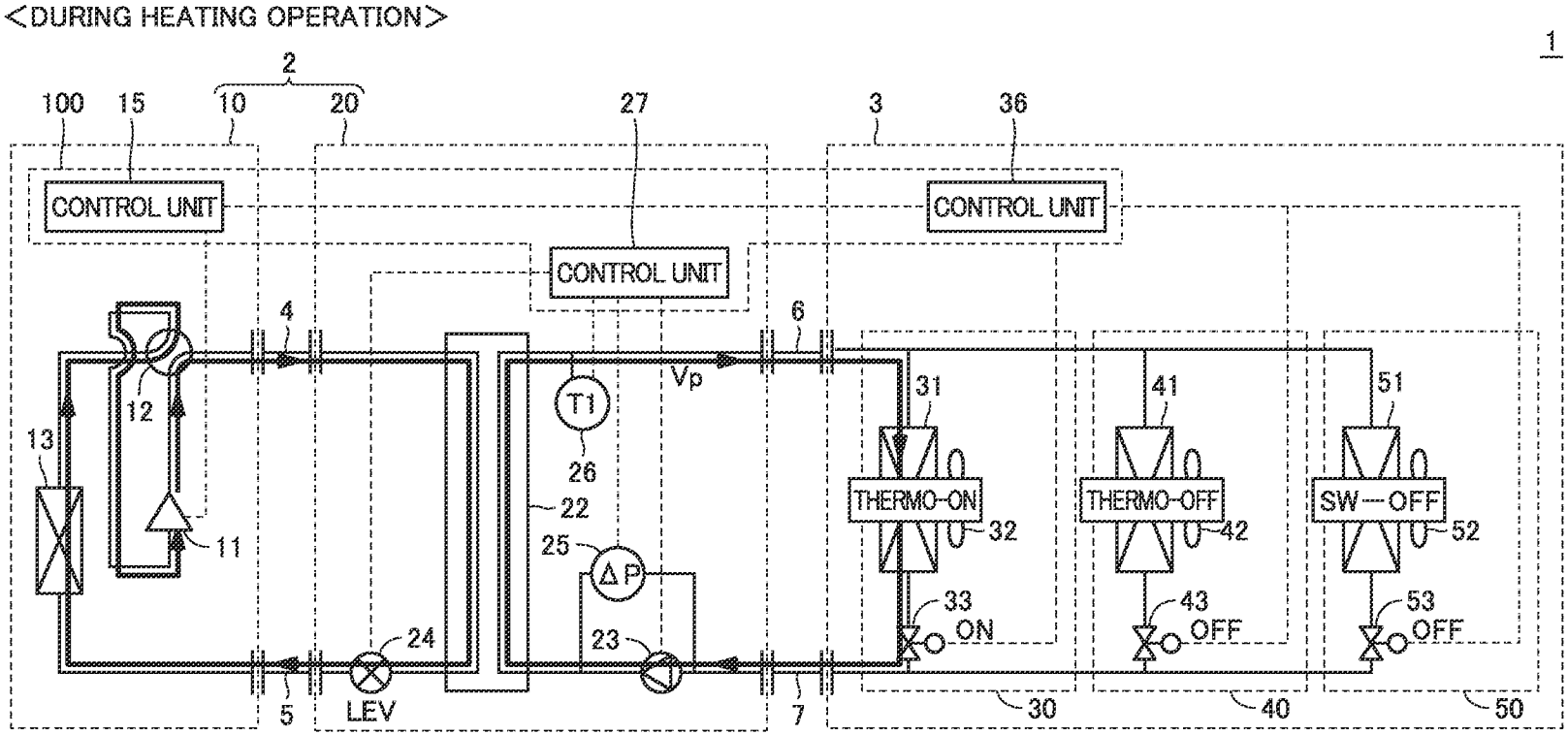
FIG. 2 is a diagram showing flows of a first heat medium and a second heat medium during heating operation.

FIG. 2 is a diagram showing flows of the first heat medium and the second heat medium during the heating operation. In FIG. 2, indoor unit 30 is described as being in the thermo-ON state, indoor unit 40 is described as being in the thermo-OFF state, and indoor unit 50 is described as being in the SW-OFF state. Note that the thermo-ON state indicates a state in which the indoor unit is being requested to perform air conditioning, and the thermo-OFF state and the SW-OFF state indicate a state in which the indoor unit is not being requested to perform air conditioning.

Stated another way, the state in which the indoor unit is not being requested to perform air conditioning includes the SW-OFF state to which a transition is made when the indoor unit is turned off by a remote controller or the like, and the thermo-OFF state in which room temperature has reached a set temperature because air conditioning was performed by the indoor unit in the thermo-ON state, and the air conditioning is being suspended.

During the heating operation, four-way valve 12 is set such that the first heat medium (refrigerant) is discharged from compressor 11, passes successively through second heat exchanger 22, expansion valve 24 and first heat exchanger 13, and returns to compressor 11. The high-temperature and high-pressure first heat medium discharged from compressor 11 exchanges heat with the second heat medium at second heat exchanger 22 and is thereby condensed. The condensed first heat medium is decompressed by expansion valve 24, evaporates into a low-temperature gaseous state at first heat exchanger 13, and returns to compressor 11.

In the second heat medium circuit, the second heat medium (water or brine) delivered from pump 23 exchanges heat with the first heat medium at second heat exchanger 22 and thereby increases in temperature. The second heat medium having the increased temperature is supplied to indoor unit 30 in the thermo-ON state, and exchanges heat with the indoor air. Indoor unit 30 in the thermo-ON state thereby supplies hot air into the room. Note that flow rate control valve 33 corresponding to indoor unit 30 in the thermo-ON state is controlled to be in an open state, and flow rate control valves 43 and 53 corresponding to indoor unit 40 in the thermo-OFF state and indoor unit 50 in the SW-OFF state are controlled to be in a closed state. Thus, the second heat medium flows through heat exchanger 31, but does not flow through heat exchangers 41 and 51.

When frost forms on the heat exchanger of outdoor unit 10 during the heating operation, four-way valve 12 is switched to introduce the high-temperature refrigerant gas from compressor 11 into first heat exchanger 13, and defrosting is performed. In this case, the second heat medium is cooled at second heat exchanger 22, and thus needs to be warmed so as not to freeze. In this case, circulation of the second heat medium by pump 23 recovers heat from air in the rooms in which indoor units 30, 40 and 50 are arranged, and warms the second heat medium.

However, if the room temperatures are collectively reduced during the defrosting for the indoor units under the three types of states as shown in FIG. 2, users in the rooms may feel uncomfortable. It is thus preferable to recover heat depending on the situation of a room.

For example, the thermo-ON state indicates that the user is in the room and that the room temperature has not reached the target temperature, namely, that it is cold. In such a case, fan 32 is stopped, and heat is not extracted from air in this room.

The thermo-OFF state indicates that the user is in the room and that the room temperature has risen to or above the target temperature. Air in such a room is a suitable source for heat extraction for early defrosting. It is also believed that a mild reduction in room temperature does not have a significant impact on the user. Therefore, heat is actively extracted from air in this room.

The SW-OFF state indicates the absence of a user. The room without a user is basically not heated. Air in such a room is an unsuitable source for heat extraction for early defrosting, but often has a temperature higher than the freezing point. Therefore, heat should be extracted from the viewpoint of effective utilization of heat.

In the present embodiment, from the viewpoint as described above, air in the room in which the indoor unit in the thermo-OFF state is arranged is preferentially utilized, over air in the room in which the indoor unit in the SW-OFF state is arranged, as a heat source for preventing the freezing of the second heat medium during the defrosting.

Figure 3:
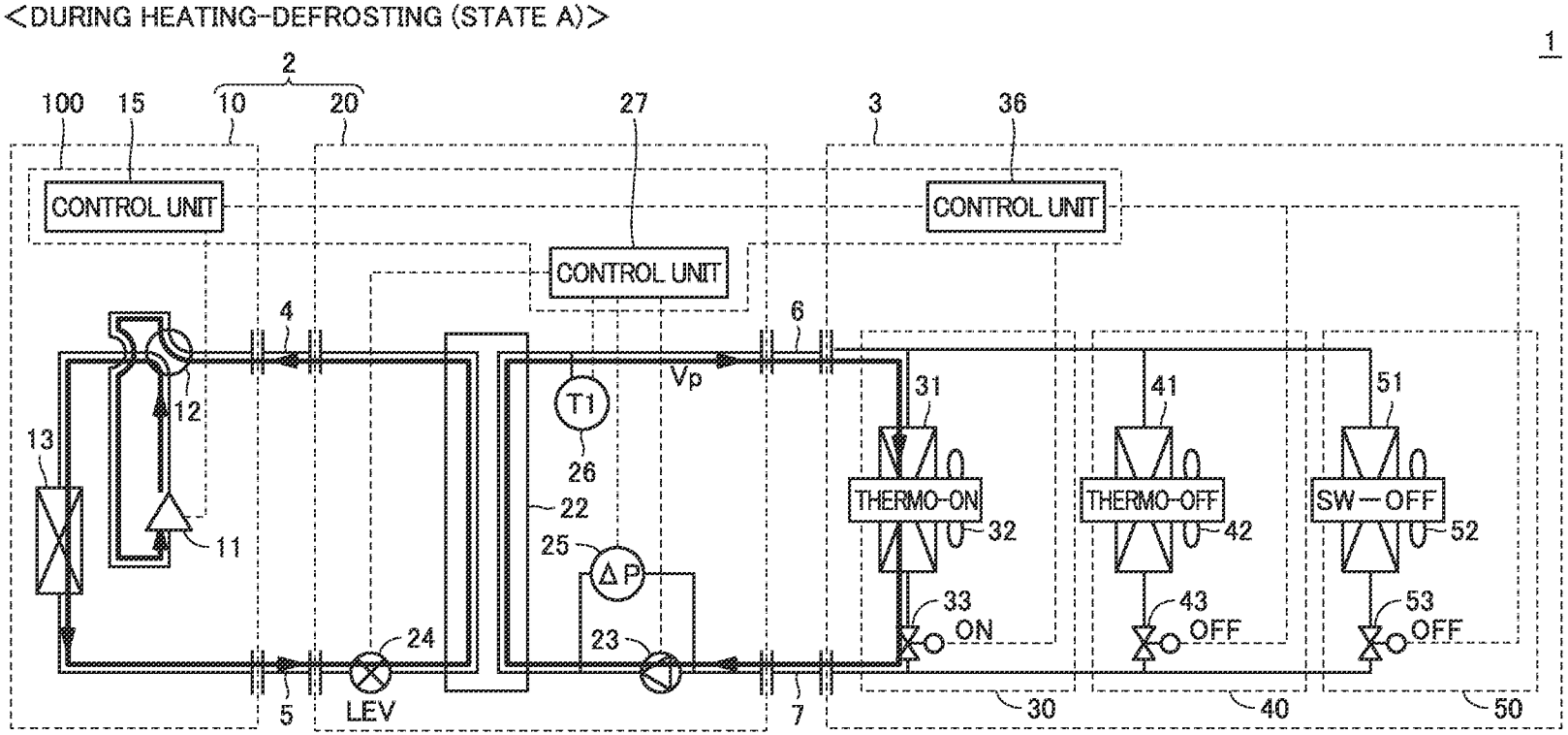
FIG. 3 is a diagram showing flows of the first heat medium and the second heat medium in heating-defrosting operation (state A).

FIG. 3 is a diagram showing flows of the first heat medium and the second heat medium in heating-defrosting operation (state A). The heating-defrosting operation (state A) is a standard state of heating-defrosting operation. Referring to FIG. 3, four-way valve 12 is set such that the first heat medium (refrigerant) is discharged from compressor 11, passes successively through first heat exchanger 13, expansion valve 24 and second heat exchanger 22, and returns to compressor 11. That is, four-way valve 12 is controlled to be in the same state as that in cooling operation. At this time, the high-temperature and high-pressure first heat medium discharged from compressor 11 exchanges heat with outdoor air at first heat exchanger 13 and is thereby condensed. At this time, the frost melts at first heat exchanger 13. The condensed first heat medium is decompressed by expansion valve 24, exchanges heat with the second heat medium and turns into a low-temperature gaseous state at second heat exchanger 22, and returns to compressor 11.

In the second heat medium circuit, the second heat medium (water or brine) delivered from pump 23 exchanges heat with the first heat medium at second heat exchanger 22 and thereby decreases in temperature. The second heat medium having the reduced temperature is supplied to indoor unit 30 in the thermo-ON state. However, fan 32 is in a stopped state, and therefore, cold air is not blown into the room. Note that flow rate control valve 33 corresponding to indoor unit 30 in the thermo-ON state is controlled to be in an open state, and flow rate control valves 43 and 53 corresponding to indoor unit 40 in the thermo-OFF state and indoor unit 50 in the SW-OFF state are controlled to be in a closed state. Thus, the second heat medium flows through heat exchanger 31, but does not flow through heat exchangers 41 and 51.

At this time, at second heat exchanger 22, the second heat medium exchanges heat with the low-temperature first heat medium and is thereby cooled. Note that when the temperature of the second heat medium at a flow-in portion of second heat exchanger 22 is low, the second heat medium is likely to freeze within second heat exchanger 22.

Figure 4:
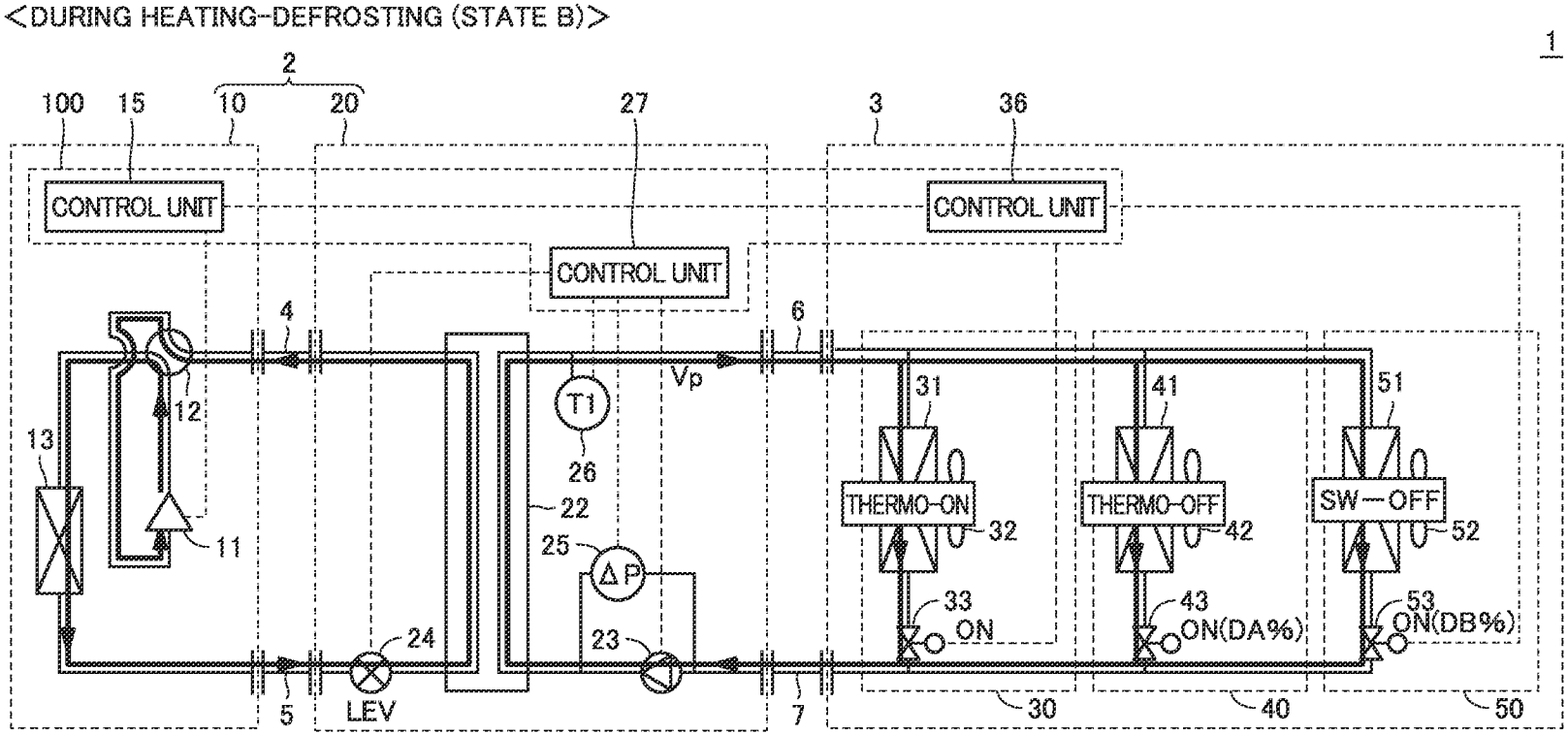
FIG. 4 is a diagram showing flows of the first heat medium and the second heat medium in heating-defrosting operation (state B).

FIG. 4 is a diagram showing flows of the first heat medium and the second heat medium in heating-defrosting operation (state B). The heating-defrosting operation (state B) is a state in which the temperature of the second heat medium has decreased during the defrosting operation. FIG. 4 is different from FIG. 3 in that, during the heating-defrosting operation, the second heat medium is also flowed through the heat exchangers that are not being requested to perform air conditioning, to absorb heat from air in the rooms in which the indoor units that are not being requested to perform air conditioning are installed. A path of circulation of the first heat medium is the same as that of FIG. 3. Thus, the second heat medium circuit in FIG. 4 is described.

Referring to FIG. 4, in the second heat medium circuit, the second heat medium (water or brine) delivered from pump 23 exchanges heat with the first heat medium at second heat exchanger 22 and thereby decreases in temperature. The second heat medium having the reduced temperature is supplied to indoor unit 30 in the thermo-ON state. However, fan 32 is in a stopped state, and therefore, cold air is not blown into the room.

In addition, the temperature of the second heat medium is monitored by temperature sensor 26. When the temperature of the second heat medium reaches a first determination temperature X° C. close to a freezing temperature, the settings of flow rate control valves 43 and 53 corresponding to indoor unit 40 in the thermo-OFF state and indoor unit 50 in the SW-OFF state are changed from the closed state to the open state. Fans 42 and 52 are also simultaneously driven, to actively perform heat exchange between the indoor air and the second heat medium at heat exchangers 41 and 51. As a result, the second heat medium increases in temperature, and is thus prevented from freezing. Therefore, the freezing at second heat exchanger 22 is prevented, and the defrosting operation does not need to be interrupted, leading to a shortened defrosting time.

At this time, in order to preferentially absorb heat from air in the room corresponding to indoor unit 40 in the thermo-OFF state in which the room temperature is now believed to be sufficiently high, controller 100 sets a degree of opening of flow rate control valve 43 to DA %, and sets a degree of opening of flow rate control valve 53 to DB %. Note that DA≥DB is satisfied. As a result, heat is preferentially absorbed into the second heat medium from air in the room corresponding to indoor unit 40 in the thermo-OFF state.

When the temperature of the second heat medium that has decreased once increases to a second determination temperature Y° C., the path of circulation of the second heat medium is set again as in FIG. 3, and the defrosting operation is continued. Note that second determination temperature Y° C. may be any temperature higher than or equal to first determination temperature X° C. While second determination temperature Y° C. may be the same temperature as first determination temperature X° C., it is preferred to set Y>X to avoid frequent occurrence of switching of the flow path.

Figure 5:
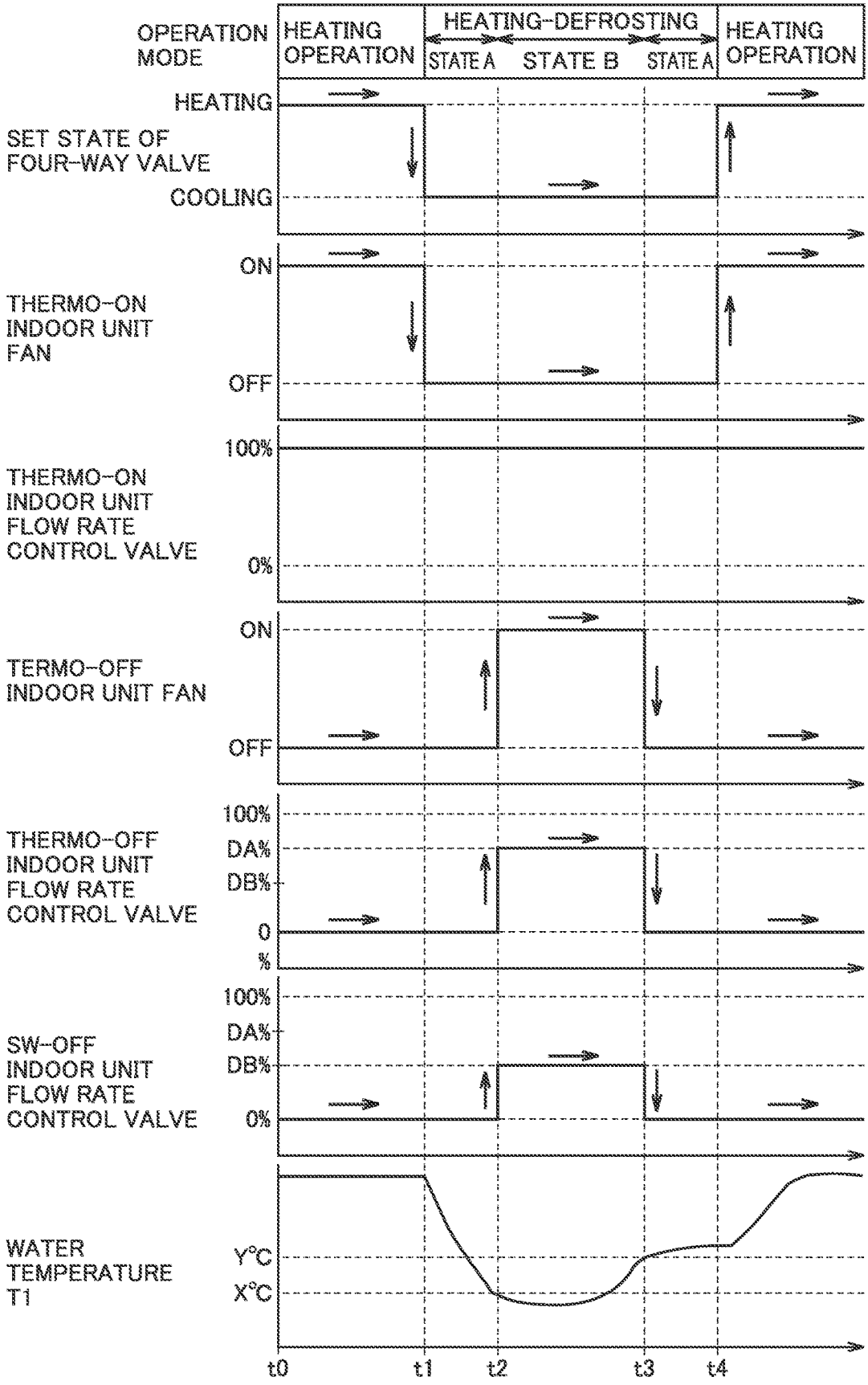
FIG. 5 shows waveform diagrams for illustrating exemplary control of the heating-defrosting operation in the first embodiment.

FIG. 5 shows waveform diagrams for illustrating exemplary control of the heating-defrosting operation in the first embodiment. Between times t0 and t1 in FIG. 5, heating operation is performed, and the first heat medium and the second heat medium flow as shown in FIG. 2.

At time t1, in response to a heating-defrosting start condition being satisfied, the state of four-way valve 12 is set from a heating state to a cooling state. Between times t1 and t2, the first heat medium and the second heat medium flow as shown in state A of FIG. 3. The heat of the second heat medium is transferred to the first heat medium at second heat exchanger 22, causing the temperature of the second heat medium to decrease gradually, and fall below first determination temperature X° C. at time t2.

In response to this, between times t2 and t3, the flow of the second heat medium is changed such that the second heat medium also flows through indoor unit 40 in the thermo-OFF state and indoor unit 50 in the SW-OFF state as shown in state B of FIG. 4. The indoor air and the second heat medium thereby exchange a greater amount of heat with each other, causing the temperature of the second heat medium to increase gradually. At this time, in order to preferentially absorb heat from air in the room corresponding to indoor unit 40 in the thermo-OFF state, controller 100 sets the degree of opening of flow rate control valve 43 to DA (%), and sets the degree of opening of flow rate control valve 53 to DB (%). Note that DA≥DB is satisfied. As a result, heat is preferentially absorbed into the second heat medium from air in the room corresponding to indoor unit 40 in the thermo-OFF state.

When the temperature of the second heat medium becomes higher than second determination temperature Y° C. at time t3, the settings of the flow rate control valves are changed again as shown in FIG. 3. Then, when a defrosting operation stop condition is satisfied at time t4, a return is made again to the heating operation as shown in FIG. 2.

Figure 6:
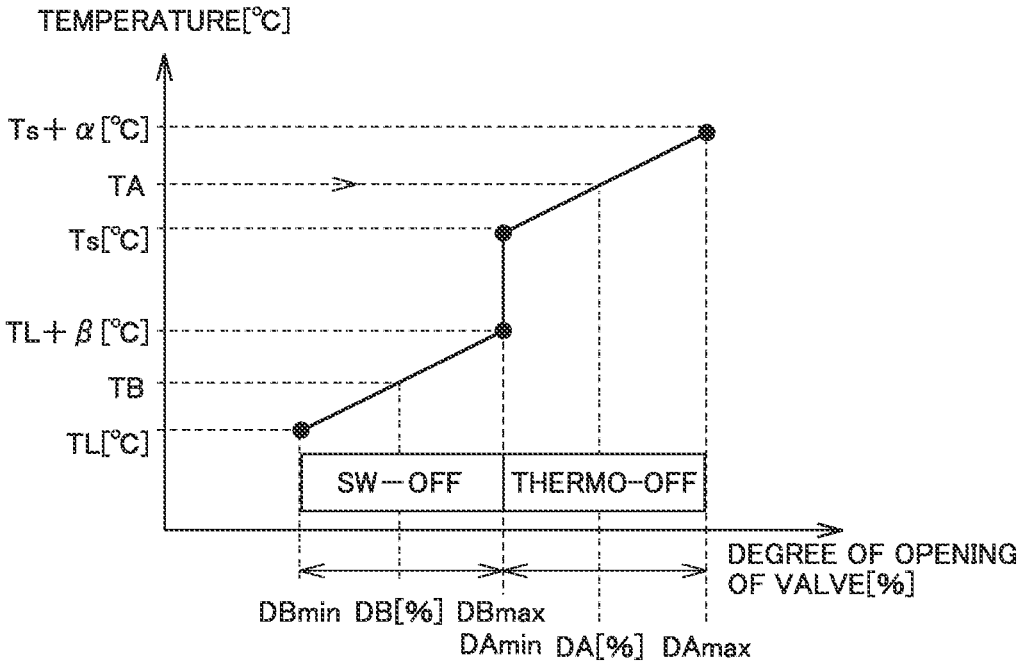
FIG. 6 is a diagram for illustrating settings of degrees of opening DA % and DB % of flow rate control valves in state B.

FIG. 6 is a diagram for illustrating the settings of degrees of opening DA and DB of the flow rate control valves in state B. In in FIG. 6, the vertical axis represents the temperature (° C.), and the horizontal axis represents the degree of opening (%) of the flow rate control valve of the indoor unit.

As shown in FIG. 6, degree of opening DA (%) is determined based on a temperature TA in the room in which indoor unit 40 in the thermo-OFF state is arranged.

When a set temperature Ts (° C.) is determined by setting of a remote controller or the like, degree of opening DA (%) of the flow rate control valve is determined such that degree of opening DA (%) increases as temperature TA increases during a period of time from that set temperature Ts (° C.) to Ts+α (° C.). When temperature TA matches set temperature Ts, for example, degree of opening DA (%) is set to DAmin (%). When temperature TA (° C.) matches Ts+α (° C.), for example, degree of opening DA (%) is set to DAmax (%).

As shown in FIG. 6, degree of opening DB (%) is determined based on a temperature TB in the room in which indoor unit 50 in the SW-OFF state is arranged.

Degree of opening DB (%) of the flow rate control valve is determined such that degree of opening DB (%) increases as temperature TB increases during a period of time from a predetermined guaranteed temperature lower limit value TL (° C.) to TL+β (° C.). Note that guaranteed temperature lower limit value TL of indoor air is a value generally described in a catalog of an air conditioning apparatus and the like. When temperature TB (° C.) matches guaranteed temperature lower limit value TL (° C.), for example, degree of opening DB (%) is set to DBmin (%). When temperature TB (° C.) matches TL+α (° C.), for example, degree of opening DB (%) is set to DBmax (%).

Figure 7:
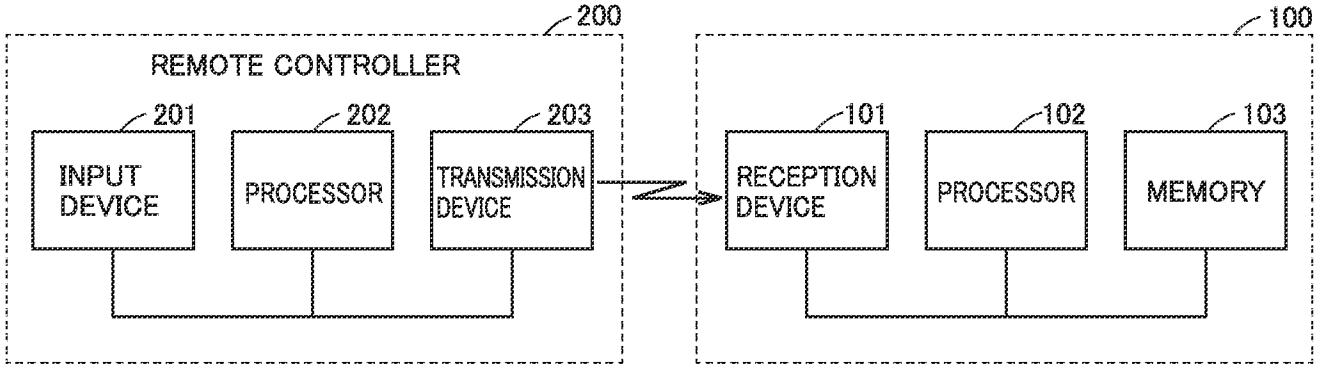
FIG. 7 is a diagram showing the configurations of a controller for controlling the air conditioning apparatus and of a remote controller for remotely controlling the controller.

FIG. 7 is a diagram showing the configurations of the controller for controlling the air conditioning apparatus and of a remote controller for remotely controlling the controller. Referring to FIG. 7, a remote controller 200 includes an input device 201, a processor 202, and a transmission device 203. Input device 201 includes a push button to switch between ON/OFF of the indoor unit by a user, a button to enter a set temperature, and the like. Transmission device 203 is for communicating with controller 100. Processor 202 controls transmission device 203 in accordance with an input signal provided from input device 201.

Controller 100 includes a reception device 101 for receiving a signal from the remote controller, a processor 102, and a memory 103.

Memory 103 includes, for example, a ROM (Read Only Memory), a RAM (Random Access Memory), and a flash memory. Note that the flash memory stores an operating system, an application program, and various types of data.

Processor 102 controls overall operation of air conditioning apparatus 1. Controller 100 shown in FIG. 1 is implemented by processor 102 executing the operating system and the application program stored in memory 103. The various types of data stored in memory 103 are referred to during the execution of the application program. Reception device 101 is for communicating with remote controller 200. When there are a plurality of indoor units, reception device 101 is provided in each of the plurality of indoor units.

When the controller is divided into a plurality of control units as shown in FIG. 1, the processor is included in each of the plurality of control units. In such a case, the plurality of processors cooperate with one another to perform overall control of air conditioning apparatus 1.

Figure 8:
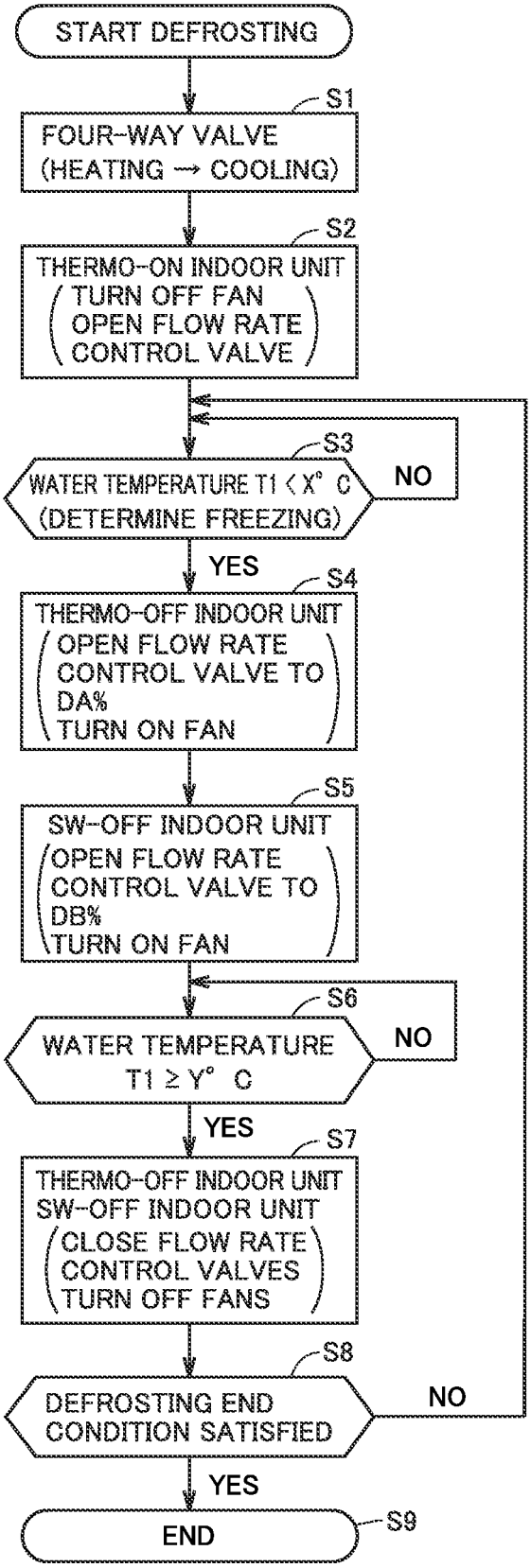
FIG. 8 is a flowchart for illustrating control performed by the controller in the first embodiment.

FIG. 8 is a flowchart for illustrating control performed by the controller in the first embodiment. Referring to FIG. 8, defrosting operation is started when a predetermined defrosting start condition is satisfied. The defrosting start condition is satisfied, for example, each time a certain time period elapses, or when the formation of frost on the heat exchanger of the outdoor unit is detected, during heating operation.

When the defrosting operation is started, first in step S1, controller 100 switches four-way valve 12 from a heating operation state to a cooling operation state. Subsequently, in step S2, controller 100 controls an indoor unit in the thermo-ON state such that its fan is turned off and its flow rate control valve is opened. This causes the second heat medium to flow as shown in state A of FIG. 3, for example.

In this state, in step S3, controller 100 determines whether or not a temperature T1 of the second heat medium detected at temperature sensor 26 is lower than first determination temperature X° C. When temperature T1 is higher than or equal to first determination temperature X° C. (NO in S3), state A of the defrosting operation shown in FIG. 3 is maintained. When temperature T1 is lower than first determination temperature X° C. (YES in S3), on the other hand, it is determined that the second heat medium is likely to freeze, and the process proceeds to step S4.

In step S4, controller 100 controls an indoor unit in the thermo-OFF state such that its flow rate control valve is opened to degree of opening DA % and its fan is turned on. Subsequently, in step S5, controller 100 controls an indoor unit in the SW-OFF state such that its flow rate control valve is opened to degree of opening DB % and its fan is turned on. This causes the second heat medium to flow as shown in state B of FIG. 4, for example.

In this state, in step S6, controller 100 determines whether or not temperature T1 of the second heat medium detected at temperature sensor 26 is higher than or equal to second determination temperature Y° C. When temperature T1 is lower than second determination temperature Y° C. (NO in S6), state B of the defrosting operation shown in FIG. 4 is maintained. When temperature T1 is higher than or equal to second determination temperature Y° C. (YES in S6), on the other hand, the process proceeds to step S7.

In step S7, controller 100 controls the indoor unit in the thermo-OFF state and the indoor unit in the SW-OFF state such that their flow rate control valves are closed and their fans are turned off. This causes the flow of the second heat medium to return to original state A as shown in FIG. 3.

In subsequent step S8, controller 100 determines whether or not a defrosting end condition is satisfied. The defrosting end condition is satisfied, for example, when a certain time period has elapsed since the start of the defrosting, or when the defrosting of the outdoor unit is completed. When the defrosting end condition is not satisfied in step S8, the processes of step S3 and the subsequent steps are repeated again. When the defrosting end condition is satisfied in step S8, on the other hand, the defrosting operation ends in step S9, and the heating operation is performed again.

Referring back to FIG. 1, the configuration and main operation of air conditioning apparatus 1 and controller 100 in the first embodiment are described.

Air conditioning apparatus 1 includes compressor 11, first heat exchanger 13, second heat exchanger 22, third heat exchangers 31, 41, 51, flow rate control valves 33, 43, 53, and pump 23.

Compressor 11 compresses the first heat medium. First heat exchanger 13 exchanges heat between the first heat medium and outdoor air. Second heat exchanger 22 exchanges heat between the first heat medium and the second heat medium. Third heat exchangers 31, 41 and 51 exchange heat between the second heat medium and indoor air. Flow rate control valves 33, 43 and 53 control the flow rates of the second heat medium flowing through third heat exchangers 31, 41 and 51, respectively. Pump 23 circulates the second heat medium between third heat exchangers 31, 41, 51 and second heat exchanger 22. Air conditioning apparatus 1 operates in operation modes including a heating mode and a defrosting mode.

More specifically, in the heating mode, as shown in FIG. 2, controller 100 opens flow rate control valve 33 corresponding to heat exchanger 31 that is being requested to perform air conditioning of third heat exchangers 31, 41 and 51, and closes flow rate control valves 43 and 53 corresponding to heat exchangers 41 and 51 that are not being requested to perform air conditioning of third heat exchangers 31, 41 and 51.

In the defrosting mode, when the second heat medium is likely to freeze, that is, when temperature T1 of the second heat medium is lower than first determination temperature X° C., controller 100 opens at least one of the flow rate control valves corresponding to the heat exchangers that are not being requested to perform air conditioning.

More specifically, in the defrosting mode, as shown in FIG. 4, controller 100 opens flow rate control valves 43 and 53 corresponding to heat exchangers 41 and 51 that are not being requested to perform air conditioning.

In this manner, when the temperature of the second heat medium decreases during the defrosting operation, the second heat medium is flowed through the heat exchangers that are not being requested to perform air conditioning. This allows heat transfer from the indoor air to the second heat medium, thus increasing the temperature of the second heat medium.

When the heat exchangers that are not being requested to perform air conditioning include a first device having a set temperature lower than or equal to the current room temperature (heat exchanger 41 in FIGS. 2 to 4) and a second device which is set so as not to perform air conditioning (heat exchanger 51 in FIGS. 2 to 4), controller 100 controls a first flow rate control valve (flow rate control valve 43) corresponding to the first device (heat exchanger 41) and a second flow rate control valve (flow rate control valve 53) corresponding to the second device (heat exchanger 51) such that the degree of opening (DA %) of the first flow rate control valve is higher than or equal to the degree of opening (DB %) of the second flow rate control valve.

Preferably, as shown in step S6 of FIG. 8, in the defrosting mode, when temperature T1 of the second heat medium is higher than or equal to second determination temperature Y° C., controller 100 closes the flow rate control valves corresponding to the heat exchangers that are not being requested to perform air conditioning.

Preferably, air conditioning apparatus 1 further includes fans 32, 42 and 52 provided to correspond to third heat exchangers 31, 41 and 51, respectively. In the heating mode, controller 100 drives the fan corresponding to the heat exchanger that is being requested to perform air conditioning, and stops the fans corresponding to the heat exchangers that are not being requested to perform air conditioning. As shown in steps S3 to S5 of FIG. 8, in the defrosting mode, when the temperature of the second heat medium is lower than first determination temperature X° C., controller 100 drives the fans corresponding to the heat exchangers that are not being requested to perform air conditioning.

Preferably, as shown in steps S6 and S7 of FIG. 8, in the defrosting mode, when the temperature of the second heat medium is higher than or equal to second determination temperature Y° C., controller 100 stops the fans corresponding to the heat exchangers that are not being requested to perform air conditioning.

In this manner, when the temperature of the second heat medium decreases during the defrosting operation, air is blown by the fans into the heat exchangers that are not being requested to perform air conditioning. This further facilitates the heat transfer from the indoor air to the second heat medium.

With such control, when the second heat medium is likely to freeze during the heating-defrosting operation, air conditioning apparatus 1 in the present embodiment collects heat from air in the rooms in the thermo-OFF state and the SW-OFF state at the expense of the temperatures in these rooms to some extent, to complete the defrosting early while preventing a reduction in temperature of the second heat medium. A defrosting time is therefore shortened, allowing for an early return to heating in the room in the thermo-ON state.

Second Embodiment

In the first embodiment, depending on whether the indoor units that are not being requested to perform air conditioning are in the thermo-OFF state or the SW-OFF state, the degrees of opening of the flow rate control valves are changed to cause a difference between the amounts of heat to be collected. In contrast, in a second embodiment, whether or not the indoor unit is arranged in a location where heat can be readily collected in defrosting operation is also considered.

Figure 9:
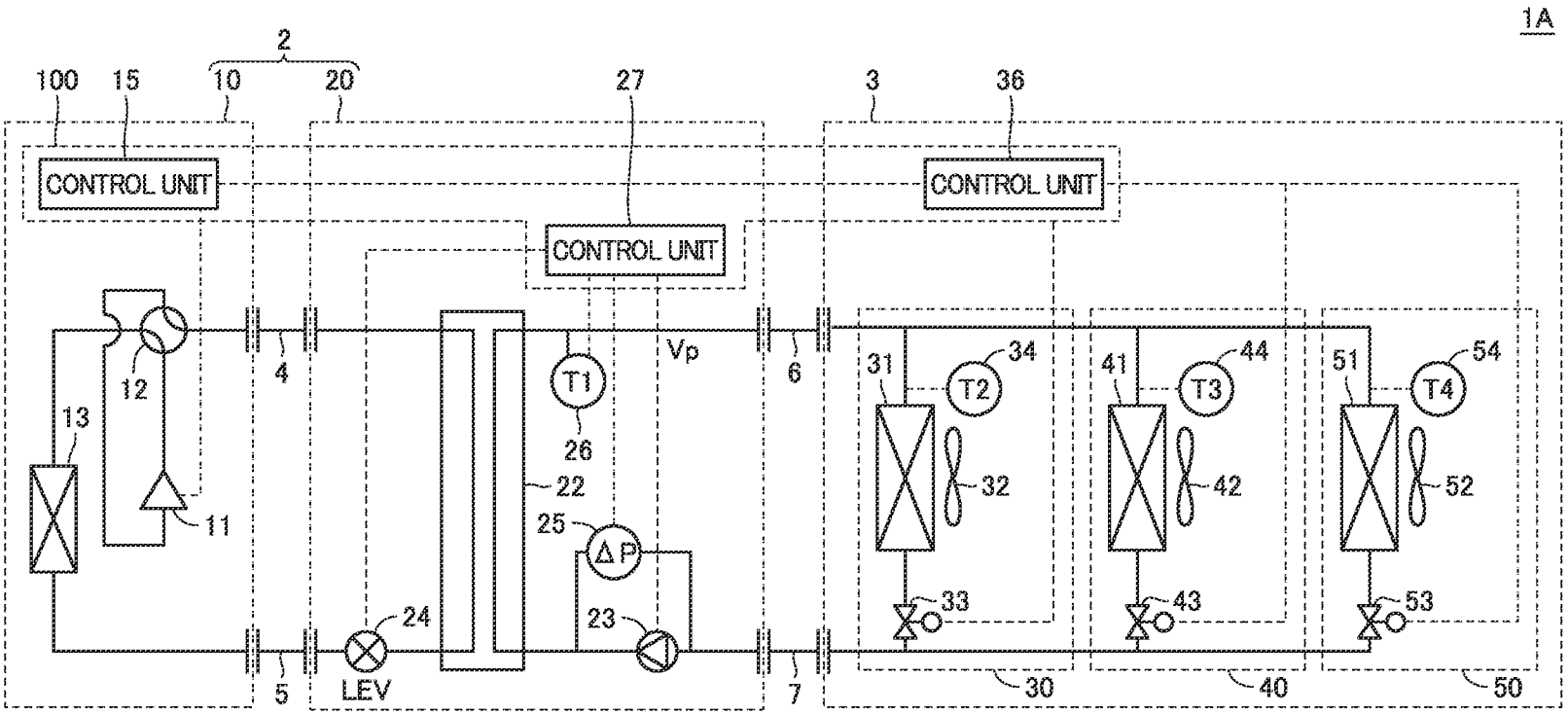
FIG. 9 is a diagram showing the configuration of an air conditioning apparatus 1A in a second embodiment.

FIG. 9 is a diagram showing the configuration of an air conditioning apparatus 1A in the second embodiment. In air conditioning apparatus 1A shown in FIG. 9, in addition to the configuration of air conditioning apparatus 1 shown in FIG. 1, indoor units 30, 40 and 50 include temperature sensors 34, 44 and 54, respectively. The configuration of air conditioning apparatus 1A is otherwise similar to that of air conditioning apparatus 1 shown in FIG. 1, and is not described repeatedly.

Temperature sensors 34, 44 and 54 measure temperatures T2, T3 and T4 of the second heat medium flowing into the indoor units, respectively, and output the temperatures to controller 100.

When the second heat medium is likely to freeze, controller 100 performs freezing-protecting operation of opening the flow rate control valve and turning on the indoor fan, preferentially from an indoor unit having a shorter length of a water pipe of the indoor units that are not being requested to perform air conditioning.

Figure 10:
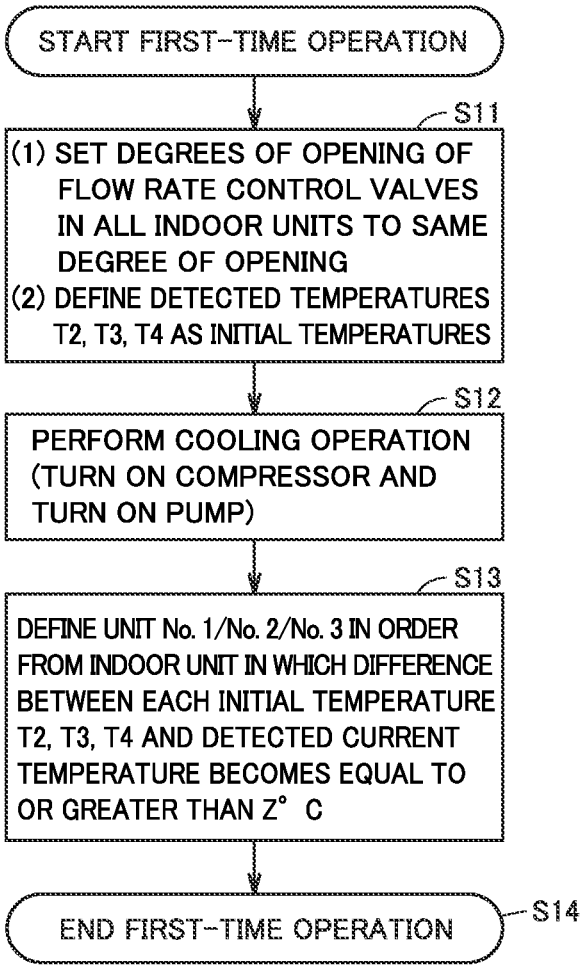
FIG. 10 is a flowchart for illustrating control performed during first-time operation in the second embodiment.

FIG. 10 is a flowchart for illustrating control performed during first-time operation in the second embodiment. Referring to FIGS. 9 and 10, the first-time operation is started when an operation command is entered for the first time after installation. In step S11, controller 100 sets degrees of opening of the flow rate control valves in all of the indoor units to the same degree of opening, and defines temperatures T2, T3 and T4 detected respectively by temperature sensors 34, 44 and 54 as initial temperatures and stores them in the memory.

Subsequently, in step S12, controller 100 performs heating operation as the first-time operation by turning on compressor 11 and turning on pump 23. Then, in step S13, controller 100 defines unit numbers of the indoor units as No. 1/No. 2/No. 3 in the order from an indoor unit in which the difference between the above-described initial temperature and the detected current temperature becomes equal to or greater than Z° C., and stores them in the memory. Then, in step S14, controller 100 ends the heating operation.

By performing this first-time operation, the unit numbers are assigned to the indoor units in the order from an indoor unit having a shorter length of the pipe for supplying the second heat medium.

Figure 11:
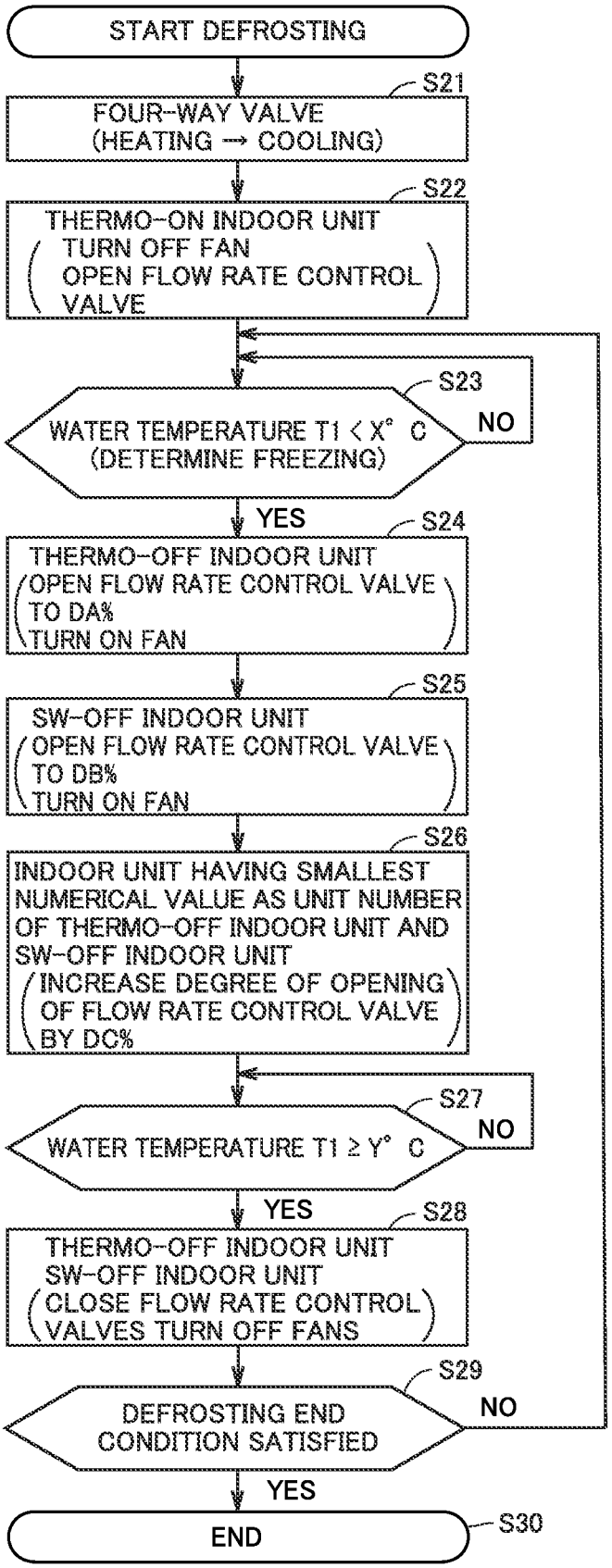
FIG. 11 is a flowchart for illustrating control performed during defrosting operation in the second embodiment.

FIG. 11 is a flowchart for illustrating control performed during defrosting operation in the second embodiment. Referring to FIG. 11, the defrosting operation is started when a predetermined defrosting start condition is satisfied. The defrosting start condition is satisfied, for example, each time a certain time period elapses, or when the formation of frost on the heat exchanger of the outdoor unit is detected, during heating operation.

When the defrosting operation is started, first in step S21, controller 100 switches four-way valve 12 from a heating operation state to a cooling operation state. Subsequently, in step S22, controller 100 controls an indoor unit in the thermo-ON state such that its fan is turned off and its flow rate control valve is opened. This causes the second heat medium to flow as shown in FIG. 3, for example.

In this state, in step S23, controller 100 determines whether or not temperature T1 of the second heat medium detected at temperature sensor 26 is lower than first determination temperature X° C. When temperature T1 is higher than or equal to first determination temperature X° C. (NO in S23), the state of the defrosting operation shown in FIG. 3 is maintained. When temperature T1 is lower than first determination temperature X° C. (YES in S23), on the other hand, the process proceeds to step S24.

In step S24, controller 100 controls an indoor unit in the thermo-OFF state such that its flow rate control valve is opened to degree of opening DA % and its fan is turned on. Subsequently, in step S25, controller 100 controls an indoor unit in the SW-OFF state such that its flow rate control valve is opened to degree of opening DB % and its fan is turned on. This causes the second heat medium to flow as shown in state B of FIG. 4, for example.

Furthermore, in the second embodiment, in step S26, controller 100 further increases, by DC %, the degree of opening of the flow rate control valve corresponding to an indoor unit having the smallest numerical value as the unit number stored during the first-time operation of the indoor unit in the thermo-OFF state and the indoor unit in the SW-OFF state.

Furthermore, in step S27, controller 100 determines whether or not temperature T1 of the second heat medium detected at temperature sensor 26 is higher than or equal to second determination temperature Y° C.

When temperature T1 is lower than second determination temperature Y° C. (NO in S27), the state of the defrosting operation with the degrees of opening of the flow rate control valves determined in step S24 to S26 is maintained. When temperature T1 is higher than or equal to second determination temperature Y° C. (YES in S27), on the other hand, the process proceeds to step S28.

In step S28, controller 100 controls the indoor unit in the thermo-OFF state and the indoor unit in the SW-OFF state such that their flow rate control valves are closed and their fans are turned off. This causes the flow of the second heat medium to return to original state A as shown in FIG. 3.

In subsequent step S29, controller 100 determines whether or not a defrosting end condition is satisfied. The defrosting end condition is satisfied, for example, when a certain time period has elapsed since the start of the defrosting, or when the defrosting of the outdoor unit is completed. When the defrosting end condition is not satisfied in step S29, the processes of step S23 and the subsequent steps are repeated again. When the defrosting end condition is satisfied in step S29, on the other hand, the defrosting operation ends in step S30, and the heating operation is performed again.

As described above, in the configuration of air conditioning apparatus 1A in the second embodiment, controller 100 includes memory 103 serving as a storage unit for storing the predetermined order of priority of third heat exchangers 31, 41 and 51, and processor 102 for changing the degree of opening (DA %) of the first flow rate control valve or the degree of opening (DB %) of the second flow rate control valve based on the order of priority stored in the storage unit.

More preferably, the order of priority is determined based on the length of a pipe, through which the second heat medium flows, from the second heat exchanger to each of third heat exchangers 31, 41 and 51.

Controller 100 increases, by DC %, the degree of opening of the flow rate control valve of an indoor unit having the shortest pipe length of the indoor units in the thermo-OFF state and the SW-OFF state.

Specifically, after the degree of opening of the flow rate control valve of the indoor unit in the thermo-OFF state is set to DA %, and the degree of opening of the flow rate control valve of the indoor unit in the SW-OFF state is set to DB %, the degree of opening of the flow rate control valve of the indoor unit having the shortest pipe length is set to (DA+DC) % or (DB+DC) %.

With such control, a further shortened defrosting time than in the first embodiment can be expected.

Third Embodiment

In the first and second embodiments, the likelihood of freezing of the second heat medium during the heating-defrosting operation is determined by detection of the temperature of the second heat medium. In a third embodiment, the likelihood of freezing of the second heat medium is determined with consideration given to other methods as well. For example, depending on the position of temperature sensor 26 or the setting of determination threshold temperature X° C., the path of circulation of the second heat medium may start to partially freeze if the circulation path is long. If the circulation path includes a section that starts to freeze in this manner, pressure loss increases, causing an increase in differential pressure ΔP between an inlet and an outlet of pump 23. In the third embodiment, therefore, in addition to temperature T1, differential pressure ΔP is also used for the determination.

Figure 12:
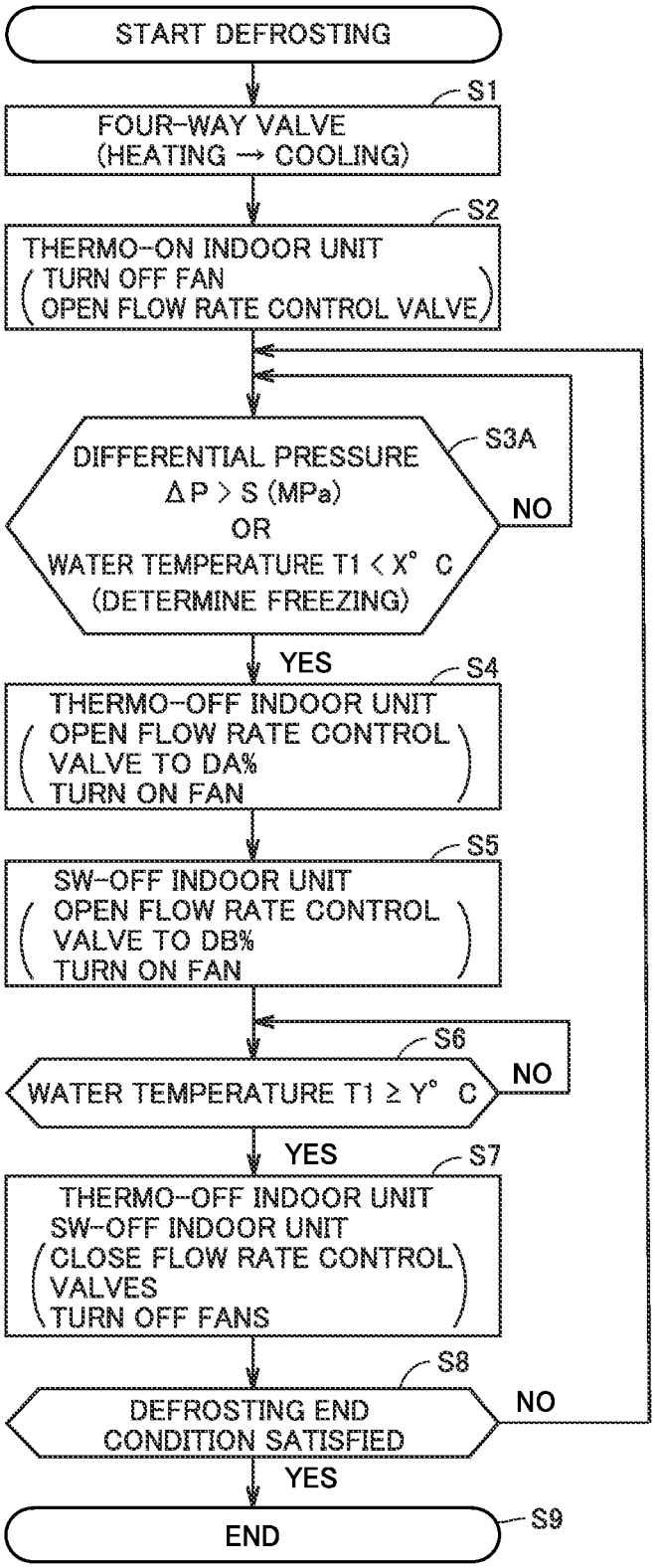
FIG. 12 is a flowchart for illustrating control performed by the controller in a third embodiment.

FIG. 12 is a flowchart for illustrating control performed by the controller in the third embodiment. In the flowchart of FIG. 12, the process of step S3 in the flowchart in the first embodiment of FIG. 8 is replaced by step S3A. The control is otherwise as described in FIG. 8, and is thus not described repeatedly.

In step S3A, controller 100 determines whether or not differential pressure ΔP is greater than a determination threshold pressure S (MPa), or whether or not temperature T1 of the second heat medium detected at temperature sensor 26 is lower than first determination temperature X° C.

As described above, in the air conditioning apparatus of the third embodiment, in the defrosting mode, controller 100 makes a change from a state in which the flow rate control valve of the thermo-ON indoor unit is opened and the flow rate control valves of the thermo-OFF and SW-OFF indoor units are closed (FIG. 3: state A) to a state in which the flow rate control valves of the thermo-ON, thermo-OFF, and SW-OFF indoor units are opened (FIG. 4: state B) based on differential pressure ΔP between the inlet of pump 23 and the outlet of pump 23.

More specifically, as shown in step S3A of FIG. 12, in the defrosting mode, controller 100 makes the change from the state in which the flow rate control valve of the thermo-ON indoor unit is opened and the flow rate control valves of the thermo-OFF and SW-OFF indoor units are closed (FIG. 3: state A) to the state in which the flow rate control valves of the thermo-ON, thermo-OFF, and SW-OFF indoor units are opened (FIG. 4: state B) when temperature T1 of the second heat medium falls below threshold temperature X° C., or when differential pressure ΔP rises above threshold pressure S.

As a result, even when the temperature of the second heat medium varies in the circulation path, the temperature of the second heat medium can be increased before the circulation path freezes completely. In addition, the defrosting operation can be normally maintained in the event of a failure of temperature sensor 26.

Note that controller 100 may have its main part disposed in any of outdoor unit 10, relay unit 20 and heat source unit 2. Air conditioning apparatuses 1 and 1A in the present embodiment may further include other configurations, so long as they include the first heat medium circuit formed by compressor 11, first heat exchanger 13 and second heat exchanger 22, the second heat medium circuit formed by pump 23, second heat exchanger 22 and third heat exchangers 31, 41 and 51, and controller 100.

It should be understood that the embodiments disclosed herein are illustrative and non-restrictive in every respect. The scope of the present disclosure is defined by the terms of the claims, rather than the description of the embodiments above, and is intended to include any modifications within the meaning and scope equivalent to the terms of the claims.

The invention claimed is:

1. A controller that controls an air conditioning apparatus configured to operate in operation modes including a heating mode and a defrosting mode, the air conditioning apparatus comprising:

a compressor configured to compress a first heat medium;

a first heat exchanger configured to exchange heat between the first heat medium and outdoor air;

a second heat exchanger configured to exchange heat between the first heat medium and a second heat medium;

a plurality of third heat exchangers each configured to exchange heat between the second heat medium and indoor air;

a plurality of flow rate control valves each configured to control a flow rate of the second heat medium flowing through a corresponding one of the plurality of third heat exchangers; and a pump configured to circulate the second heat medium between the plurality of third heat exchangers and the second heat exchanger, wherein in the heating mode, the controller is configured to open at least one flow rate control valve of the plurality of flow rate control valves corresponding to at least one heat exchanger of the plurality of third heat exchangers that is being requested to perform air conditioning, and to close at least one flow rate control valve of the plurality of flow rate control valves corresponding to at least one heat exchanger of the plurality of third heat exchangers that is not being requested to perform air conditioning, in the defrosting mode, the controller is configured to open the at least one flow rate control valve corresponding to the at least one heat exchanger of the plurality of third heat exchangers that is not being requested to perform air conditioning, and when the at least one heat exchanger of the plurality of third heat exchangers that is not being requested to perform air conditioning includes a heat exchanger having a set temperature lower than or equal to a current room temperature and a heat exchanger which is set so as not to perform air conditioning, the controller is configured to control a first flow rate control valve of the plurality of flow rate control valves corresponding to the heat exchanger having the set temperature lower than or equal to the current room temperature and a second flow rate control valve of the plurality of flow rate control valves corresponding to the heat exchanger which is set so as not to perform air conditioning such that a degree of opening of the first flow rate control valve is higher than or equal to a degree of opening of the second flow rate control valve.

2. The controller according to claim 1, comprising:

a memory configured to store a predetermined order of priority of the plurality of third heat exchangers; and a processor configured to change the degree of opening of the first flow rate control valve or the degree of opening of the second flow rate control valve based on the order of priority stored in the memory.

3. The controller according to claim 2, wherein the order of priority is determined based on a length of a pipe, through which the second heat medium flows, from the second heat exchanger to each of the plurality of third heat exchangers.

4. The controller according to claim 1, wherein in the defrosting mode, the controller is configured to make a change from a state in which the at least one flow rate control valve of the plurality of flow rate control valves corresponding to the at least one heat exchanger of the plurality of third heat exchangers that is not being requested to perform air conditioning is closed to a state in which the at least one flow rate control valve of the plurality of flow rate control valves corresponding to the at least one heat exchanger of the plurality of third heat exchangers that is not being requested to perform air conditioning is opened based on a differential pressure between an inlet of the pump and an outlet of the pump.

5. The controller according to claim 4, wherein in the defrosting mode, the controller is configured to make the change from the state in which the at least one flow rate control valve of the plurality of flow rate control valves corresponding to the at least one heat exchanger of the plurality of third heat exchangers that is not being requested to perform air conditioning is closed to the state in which the at least one flow rate control valve of the plurality of flow rate control valves corresponding to the at least one heat exchanger of the plurality of third heat exchangers that is not being requested to perform air conditioning is opened when a temperature of the second heat medium falls below a threshold temperature, or when the differential pressure rises above a threshold pressure.

6. The controller according to claim 1, further comprising:

an outdoor unit comprising:

the compressor; and the first heat exchanger.

7. The controller according to claim 1, further comprising:

a relay unit comprising:

the second heat exchanger; and the pump.

8. The controller according to claim 1, further comprising:

a heat source unit comprising:

the compressor;

the first heat exchanger;

the second heat exchanger; and the pump.

9. The controller according to claim 1, wherein the air conditioning apparatus comprises:

a first heat medium circuit formed by the compressor, the first heat exchanger, and the second heat exchanger; and a second heat medium circuit formed by the pump, the second heat exchanger, and the plurality of third heat exchangers.

* * * * *